US008734273B2

(12) United States Patent
Tachibana et al.

(10) Patent No.: US 8,734,273 B2
(45) Date of Patent: May 27, 2014

(54) GOLF BALL

(75) Inventors: Kosuke Tachibana, Kobe (JP); Kazuhiko Isogawa, Kobe (JP)

(73) Assignee: SRI Sports Limited, Kobi (JP)

( * ) Notice: Subject to any disclaimer, the term of this patent is extended or adjusted under 35 U.S.C. 154(b) by 384 days.

(21) Appl. No.: 13/298,526

(22) Filed: Nov. 17, 2011

(65) Prior Publication Data

US 2012/0165123 A1 Jun. 28, 2012

(30) Foreign Application Priority Data

Dec. 22, 2010 (JP) ..... 2010-285241

(51) Int. Cl.
*A63B 37/04* (2006.01)

(52) U.S. Cl.
USPC ..... 473/371; 473/376

(58) Field of Classification Search
USPC ..... 473/351–377
See application file for complete search history.

(56) References Cited

U.S. PATENT DOCUMENTS

| | | | | | |
|---|---|---|---|---|---|
| 4,714,253 | A | * | 12/1987 | Nakahara et al. | 473/373 |
| 4,974,852 | A | * | 12/1990 | Hiraoka et al. | 473/372 |
| 5,002,281 | A | * | 3/1991 | Nakahara et al. | 473/373 |
| 5,033,748 | A | * | 7/1991 | Ebisuno | 473/372 |
| 5,072,944 | A | | 12/1991 | Nakahara et al. | |
| 5,403,010 | A | | 4/1995 | Yabuki et al. | |
| 5,516,110 | A | * | 5/1996 | Yabuki et al. | 473/372 |
| 5,562,287 | A | | 10/1996 | Endo et al. | |
| 5,697,856 | A | * | 12/1997 | Moriyama et al. | 473/374 |
| 5,803,833 | A | * | 9/1998 | Nakamura et al. | 473/377 |
| 6,390,935 | B1 | * | 5/2002 | Sugimoto | 473/373 |
| 6,533,683 | B2 | * | 3/2003 | Watanabe | 473/374 |
| 6,537,158 | B2 | * | 3/2003 | Watanabe | 473/374 |
| 6,919,393 | B2 | * | 7/2005 | Mano et al. | 524/347 |
| 7,329,194 | B2 | * | 2/2008 | Watanabe et al. | 473/376 |
| 7,410,429 | B1 | * | 8/2008 | Bulpett et al. | 473/376 |
| 7,429,221 | B1 | * | 9/2008 | Bulpett et al. | 473/376 |
| 7,582,027 | B2 | * | 9/2009 | Bulpett et al. | 473/376 |
| 7,744,489 | B2 | * | 6/2010 | Sullivan et al. | 473/373 |
| 7,762,910 | B2 | * | 7/2010 | Sullivan et al. | 473/376 |
| 7,815,526 | B2 | * | 10/2010 | Sullivan et al. | 473/376 |
| 2002/0019269 | A1 | | 2/2002 | Watanabe | |
| 2003/0032501 | A1 | | 2/2003 | Sakagami et al. | |
| 2008/0194357 | A1 | | 8/2008 | Higuchi | |
| 2008/0312008 | A1 | | 12/2008 | Higuchi et al. | |
| 2011/0159999 | A1 | | 6/2011 | Ohama et al. | |

FOREIGN PATENT DOCUMENTS

| | | |
|---|---|---|
| JP | 2010-22504 A | 2/2010 |

* cited by examiner

*Primary Examiner* — Alvin Hunter
(74) *Attorney, Agent, or Firm* — Birch, Stewart, Kolasch & Birch, LLP

(57) ABSTRACT

A golf ball 2 includes a core 4, a mid layer 6 positioned outside the core 4, a reinforcing layer 8 positioned outside the mid layer 6, and a cover 10 positioned outside the reinforcing layer 8. The difference between: a JIS-C hardness H(5.0) and a JIS-C hardness Ho at the central point is 6.0 or greater. The difference between: a JIS-C hardness H(12.5) and the hardness H(5.0) is 4.0 or less. The difference between a JIS-C hardness Hs at the surface of the core 4 and the hardness H(12.5) is 10.0 or greater. The difference between the hardness Hs and the hardness Ho is 22.0 or greater. In the golf ball 2, there is no zone in which a hardness decreases from the central point toward the surface. A hardness H2 of the mid layer 6 is greater than a hardness H3 of the cover 10.

12 Claims, 13 Drawing Sheets

GOLF BALL

This application claims priority on Patent Application No. 2010-285241 filed in JAPAN on Dec. 22, 2010. The entire contents of this Japanese Patent Application are hereby incorporated by reference.

BACKGROUND OF THE INVENTION

1. Field of the Invention

The present invention relates to golf balls. Specifically, the present invention relates to golf balls that include a solid core, a mid layer, and a cover.

2. Description of the Related Art

Golf players' foremost requirement for golf balls is flight performance. Golf players place importance on flight performance upon shots with a driver, a long iron, and a middle iron. Flight performance correlates with the resilience performance of a golf ball. When a golf ball having excellent resilience performance is hit, the golf ball flies at a high speed, thereby achieving a large flight distance.

An appropriate trajectory height is required in order to achieve a large flight distance. A trajectory height depends on a spin rate and a launch angle. In a golf ball that achieves a high trajectory by a high spin rate, a flight distance is insufficient. In a golf ball that achieves a high trajectory by a high launch angle, a large flight distance is obtained. An outer-hard/inner-soft structure in a golf ball can achieve a low spin rate and a high launch angle.

Golf players also place importance on spin performance of golf balls. When a backspin rate is high, the run is short. It is easy for golf players to cause a golf ball, to which backspin is easily provided, to stop at a target point. When a sidespin rate is high, the golf ball tends to curve. It is easy for golf players to intentionally cause a golf ball, to which sidespin is easily provided, to curve. A golf ball to which spin is easily provided has excellent controllability. In particular, advanced golf players place importance on controllability upon a shot with a short iron.

JPH2-264674 (U.S. Pat. No. 5,072,944) discloses a golf ball that includes a core consisting of a center core and an outer layer. The center core is flexible, and the outer layer is hard. The core suppresses a spin rate.

JPH6-98949 (U.S. Pat. No. 5,516,110) discloses a golf ball having a constant hardness between: a point that is located at a distance of 5 mm from a central point; and a point that is located at a distance of 10 mm from the central point. A similar golf ball is also disclosed in JPH6-154357 (U.S. Pat. No. 5,403,010).

JPH7-112036 (U.S. Pat. No. 5,562,287) discloses a golf ball having a small difference between a central hardness and a surface hardness of a core. The core contributes to the resilience performance of the golf ball.

JP2002-765 (US 2002/0019269) discloses a golf ball having a great difference between a central hardness and a surface hardness of a core.

JP2003-33447 (US 2003/0032501) discloses a golf ball that includes a core for which a rubber composition includes a polysulfide. The polysulfide contributes to the resilience performance of the golf ball.

JP2008-194473 (US 2008/0194357 and US 2008/0312008) discloses a golf ball having a great difference between a central hardness and a surface hardness of a core. A similar golf ball is also disclosed in JP2010-22504.

In the golf ball disclosed in JPH2-264674, the structure of the core is complicated. The core produces an energy loss when being hit. In addition, the core has inferior durability.

In the golf ball disclosed in JPH6-98949, a range where the hardness is constant is narrow. The golf ball has inferior resilience performance. Similarly, the golf ball disclosed in JPH6-154357 also has inferior resilience performance.

In the golf ball disclosed in JPH7-112036, a spin rate is excessive. The golf ball has a small flight distance.

The golf ball disclosed in JP2002-765 has inferior resilience performance.

In the golf ball disclosed in JP2003-33447, a spin rate is excessive. The golf ball has inferior flight performance.

In the golf ball disclosed in JP2008-194473, there is a zone in which a hardness decreases from the central point of the core toward the surface of the core. The golf ball has inferior resilience performance. In the golf ball, a spin rate is excessive. The golf ball has inferior flight performance. Similarly, the golf ball disclosed in JP2010-22504 also has inferior flight performance.

An object of the present invention is to provide a golf ball having excellent flight performance.

SUMMARY OF THE INVENTION

A golf ball according to the present invention comprises a core, a mid layer positioned outside the core, and a cover positioned outside the mid layer. A difference between: a JIS-C hardness H(5.0) at a point that is located at a distance of 5 mm from a central point of the core; and a JIS-C hardness Ho at the central point is equal to or greater than 6.0. A difference between: a JIS-C hardness H(12.5) at a point that is located at a distance of 12.5 mm from the central point; and the hardness H(5.0) is equal to or less than 4.0. A difference between a JIS-C hardness Hs at a surface of the core and the hardness H(12.5) is equal to or greater than 10.0. A difference between the hardness Hs and the hardness Ho is equal to or greater than 22.0. In the golf ball, there is no zone in which a hardness decreases from the central point toward the surface. A Shore D hardness H2 of the mid layer is greater than a Shore D hardness H3 of the cover.

In the golf ball according to the present invention, a hardness distribution is appropriate. In the golf ball, the energy loss is low when being hit. The golf ball has excellent resilience performance. When the golf ball is hit with a driver, the spin rate is low. The great resilience performance and the low spin rate achieve a large flight distance. When the golf ball is hit with a short iron, the spin rate is high. The golf ball has excellent controllability.

The core can be formed by crosslinking a rubber composition that includes a base rubber and an organic sulfur compound. Preferably, the organic sulfur compound has a molecular weight of 150 or higher but 200 or lower and a melting point of 65° C. or higher but 90° C. or lower. Preferably, the rubber composition includes the base rubber in an amount of 100 parts by weight, and the organic sulfur compound in an amount that is equal to or greater than 0.05 parts by weight but equal to or less than 3.0 parts by weight. Preferably, the sulfur compound is 2-naphthalenethiol.

Preferably, the hardness Ho is equal to or greater than 40.0 but equal to or less than 70.0, and the hardness Hs is equal to or greater than 78.0 but equal to or less than 95.0.

Preferably, a thickness of the mid layer is equal to or greater than 0.5 mm but equal to or less than 1.5 mm, and a thickness of the cover is equal to or less than 0.8 mm.

Preferably, a difference (H2−H3) between the hardness H2 and the hardness H3 is equal to or greater than 30.

A base polymer of the mid layer may be different from a base polymer of the cover. In this case, preferably, the golf ball further comprises a reinforcing layer between the mid layer and the cover.

DESCRIPTION OF THE PREFERRED EMBODIMENTS

The following will describe in detail the present invention, based on preferred embodiments with reference to the accompanying drawings.

Figure 1:
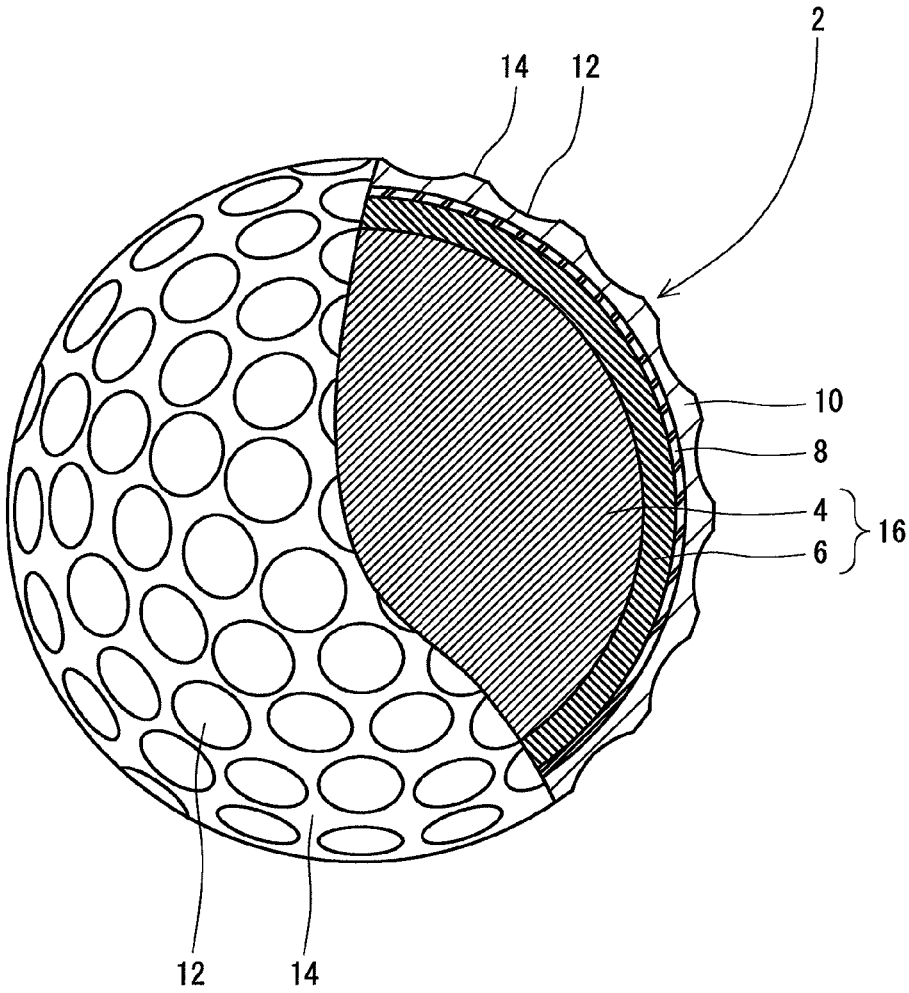
FIG. 1 is a partially cutaway cross-sectional view of a golf ball according to one embodiment of the present invention.

A golf ball 2 shown in FIG. 1 includes a spherical core 4, a mid layer 6 positioned outside the core 4, a reinforcing layer 8 positioned outside the mid layer 6, and a cover 10 positioned outside the reinforcing layer 8. On the surface of the cover 10, a large number of dimples 12 are formed. Of the surface of the golf ball 2, a part other than the dimples 12 is a land 14. The golf ball 2 includes a paint layer and a mark layer on the external side of the cover 10 although these layers are not shown in the drawing.

The golf ball 2 has a diameter of 40 mm or greater but 45 mm or less. From the standpoint of conformity to the rules established by the United States Golf Association (USGA), the diameter is preferably equal to or greater than 42.67 mm. In light of suppression of air resistance, the diameter is preferably equal to or less than 44 mm and more preferably equal to or less than 42.80 mm. The golf ball 2 has a weight of 40 g or greater but 50 g or less. In light of attainment of great inertia, the weight is preferably equal to or greater than 44 g and more preferably equal to or greater than 45.00 g. From the standpoint of conformity to the rules established by the USGA, the weight is preferably equal to or less than 45.93 g.

In the present invention, a JIS-C hardness at a point that is located at a distance of x (mm) from the central point of the core 4 is indicated by H(x). In the present invention, a hardness at the central point of the core 4 is indicated by Ho, and a surface hardness of the core 4 is indicated by Hs.

The hardness Ho and the hardness H(x) are measured by pressing a JIS-C type hardness scale against a cut plane of the core 4 that has been cut into two halves. For the measurement, an automated rubber hardness measurement machine (trade name "P1", manufactured by Kobunshi Keiki Co., Ltd.), to which this hardness scale is mounted, is used. The hardness Hs is measured by pressing a JIS-C type hardness scale against the surface of the core 4. For the measurement, an automated rubber hardness measurement machine (trade name "P1", manufactured by Kobunshi Keiki Co., Ltd.), to which this hardness scale is mounted, is used.

Figure 2:
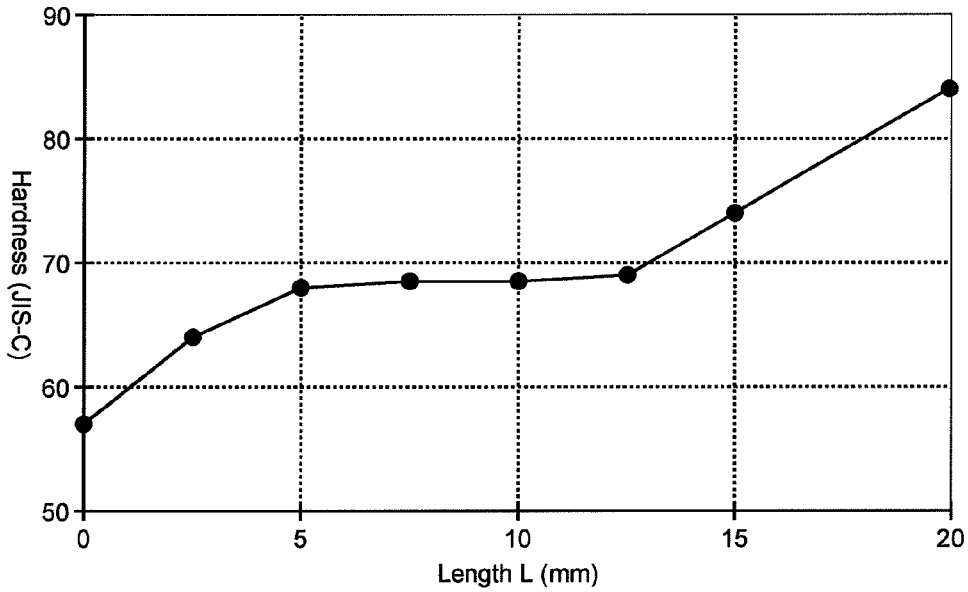
FIG. 2 is a graph showing a hardness distribution of a core of the golf ball in FIG. 1.

FIG. 2 shows a hardness distribution of the core 4. In this embodiment, the core 4 has a diameter of 39.9 mm. Thus, in FIG. 2, a hardness at a point that is located at a distance of 19.95 mm from the central point is the hardness Hs at the surface. As is obvious from FIG. 2, in the core 4, there is no zone in which the hardness decreases from the central point toward the surface. The core 4 has an outer-hard/inner-soft structure. The core 4 has a low energy loss when being hit. The core 4 has excellent resilience performance. In the core 4, spin is suppressed. The core 4 contributes to the flight performance of the golf ball 2.

As shown in FIG. 2, in this embodiment, a hardness H(5.0) is 68.0, and the hardness Ho is 57.0. The difference (H(5.0)−Ho) between the hardness H(5.0) and the hardness Ho is 11.0. The difference (H(5.0)−Ho) is great. In the golf ball 2 in which the difference (H(5.0)−Ho) is great, a spin rate is low when the golf ball 2 is hit with a driver. The low spin rate can achieve a large flight distance. In light of suppression of spin, the difference (H(5.0)−Ho) is preferably equal to or greater than 6.0 and particularly preferably equal to or greater than 8.0. In light of ease of producing the core 4, the difference (H(5.0)−Ho) is preferably equal to or less than 15.0.

As shown in FIG. 2, in this embodiment, a hardness H(12.5) is 69.0, and the hardness H(5.0) is 68.0. The difference (H(12.5)−H(5.0)) between the hardness H(12.5) and the hardness H(5.0) is 1.0. The difference (H(12.5)−H(5.0)) is small. In the core 4, the hardness distribution curve is almost flat between: a point that is located at a distance of 5.0 mm from the central point; and a point that is located at a distance of 12.5 mm from the central point. In the golf ball 2 in which the difference (H(12.5)−H(5.0)) is small, an energy loss is low when the golf ball 2 is hit with a driver. The golf ball 2 has excellent resilience performance. In light of resilience performance, the difference (H(12.5)−H(5.0)) is preferably equal to or greater than 0.0 but equal to or less than 4.0, more preferably equal to or greater than 0.5 but equal to or less than 3.0, and particularly preferably equal to or greater than 0.5 but equal to or less than 1.5.

As shown in FIG. 2, in this embodiment, the hardness Hs is 84.0, and the hardness H(12.5) is 69.0. The difference (Hs−H(12.5)) between the hardness Hs and the hardness H(12.5) is 15.0. The difference (Hs−H(12.5)) is great. In the golf ball 2 in which the difference (Hs−H(12.5)) is great, a spin rate is low when the golf ball 2 is hit with a driver. The low spin rate can achieve a large flight distance. In light of suppression of spin, the difference (Hs−H(12.5)) is preferably equal or greater than 10.0, more preferably equal to or greater than 13.0, and particularly preferably equal to or greater than 14.0. In light of ease of producing the core 4, the difference (Hs−H(12.5)) is preferably equal to or less than 20.0.

As described above, in this embodiment, the hardness Ho is 57.0, and the hardness Hs is 84.0. The difference (Hs−Ho) between the hardness Hs and the hardness Ho is 27.0. The difference (Hs−Ho) is great. In the golf ball 2 in which the difference (Hs−Ho) is great, a spin rate is low when the golf ball 2 is hit with a driver. The low spin rate can achieve a large flight distance. In light of suppression of spin, the difference (Hs−Ho) is preferably equal to or greater than 22.0 and particularly preferably equal to or greater than 24.0. In light of ease of producing the core 4, the difference (Hs−Ho) is preferably equal to or less than 35.0.

The hardness Ho at the central point is preferably equal to or greater than 40.0 but equal to or less than 70.0. The golf ball 2 in which the hardness Ho is equal to or greater than 40.0 has excellent resilience performance. In this respect, the hardness Ho is more preferably equal to or greater than 45.0 and particularly preferably equal to or greater than 50.0. The core 4 in which the hardness Ho is equal to or less than 70.0 can achieve an outer-hard/inner-soft structure. In the golf ball 2 that includes this core 4, spin can be suppressed. In this respect, the hardness Ho is more preferably equal to or less than 68.0 and particularly preferably equal to or less than 66.0.

The hardness H(5.0) is preferably equal to or greater than 63.0 but equal to or less than 73.0. The golf ball 2 in which the hardness H(5.0) is equal to or greater than 63.0 has excellent resilience performance. In this respect, the hardness H(5.0) is particularly preferably equal to or greater than 65.0. The golf ball 2 in which the hardness H(5.0) is equal to or less than 73.0 provides excellent feel at impact. In this respect, the hardness H(5.0) is particularly preferably equal to or less than 71.0.

The hardness H(12.5) is preferably equal to or greater than 64.0 but equal to or less than 74.0. The golf ball 2 in which the hardness H(12.5) is equal to or greater than 64.0 has excellent resilience performance. In this respect, the hardness H(12.5) is particularly preferably equal to or greater than 66.0. The golf ball 2 in which the hardness H(12.5) is equal to or less than 74.0 provides excellent feel at impact. In this respect, the hardness H(12.5) is particularly preferably equal to or less than 72.0.

The hardness Hs at the surface of the core 4 is preferably equal to or greater than 78.0 but equal to or less than 95.0. The core 4 in which the hardness Hs is equal to or greater than 78.0 can achieve an outer-hard/inner-soft structure. In the golf ball 2 that includes this core 4, spin can be suppressed. In this respect, the hardness Hs is more preferably equal to or greater than 80.0 and particularly preferably equal to or greater than 82.0. The golf ball 2 in which the hardness Hs is equal to or less than 95.0 has excellent durability. In this respect, the hardness Hs is more preferably equal to or less than 93.0 and particularly preferably equal to or less than 90.0.

The core 4 is obtained by crosslinking a rubber composition. Examples of base rubbers for the rubber composition of the core 4 include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred if the polybutadiene is included as a principal component. Specifically, the proportion of the polybutadiene to the entire base rubber is preferably equal to or greater than 50% by weight and more preferably equal to or greater than 80% by weight. The proportion of cis-1,4 bonds in the polybutadiene is preferably equal to or greater than 40% and more preferably equal to or greater than 80%.

The rubber composition of the core 4 includes a co-crosslinking agent. The co-crosslinking agent achieves high resilience of the core 4. Examples of preferable co-crosslinking agents in light of resilience performance include monovalent or bivalent metal salts of an α,β-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are particularly preferred.

In light of resilience performance of the golf ball 2, the amount of the co-crosslinking agent is preferably equal to or greater than 15 parts by weight, and more preferably equal to or greater than 25 parts by weight, per 100 parts by weight of the base rubber. In light of soft feel at impact, the amount of the co-crosslinking agent is preferably equal to or less than 50 parts by weight, and particularly preferably equal to or less than 45 parts by weight, per 100 parts by weight of the base rubber.

Preferably, the rubber composition of the core 4 includes an organic peroxide. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. In light of versatility, dicumyl peroxide is preferred.

In light of resilience performance of the golf ball 2, the amount of the organic peroxide is preferably equal to or greater than 0.1 parts by weight, more preferably equal to or greater than 0.2 parts by weight, and particularly preferably equal to or greater than 0.3 parts by weight, per 100 parts by weight of the base rubber. In light of soft feel at impact, the amount of the organic peroxide is preferably equal to or less than 2.0 parts by weight, more preferably equal to or less than 1.5 parts by weight, and particularly preferably equal to or less than 1.0 parts by weight, per 100 parts by weight of the base rubber.

Preferably, the rubber composition of the core 4 includes an organic sulfur compound. In light of achievement of both excellent resilience performance and a low spin rate, an organic sulfur compound having a molecular weight of 150 or higher but 200 or lower is preferred. The molecular weight is particularly preferably equal to or higher than 155. The molecular weight is particularly preferably equal to or lower than 170.

In light of achievement of both excellent resilience performance and a low spin rate, an organic sulfur compound having a melting point of 65° C. or higher but 90° C. or lower is preferred. The melting point is particularly preferably equal to or higher than 75° C. The melting point is particularly preferably equal to or lower than 85° C.

Organic sulfur compounds include naphthalenethiol type compounds, benzenethiol type compounds, and disulfide type compounds.

Examples of naphthalenethiol type compounds include 1-naphthalenethiol, 2-naphthalenethiol, 4-chloro-1-naphthalenethiol, 4-bromo-1-naphthalenethiol, 1-chloro-2-naphthalenethiol, 1-bromo-2-naphthalenethiol, 1-fluoro-2-naphthalenethiol, 1-cyano-2-naphthalenethiol, and 1-acetyl-2-naphthalenethiol.

Examples of benzenethiol type compounds include benzenethiol, 4-chlorobenzenethiol, 3-chlorobenzenethiol, 4-bromobenzenethiol, 3-bromobenzenethiol, 4-fluorobenzenethiol, 4-iodobenzenethiol, 2,5-dichlorobenzenethiol, 3,5-dichlorobenzenethiol, 2,6-dichlorobenzenethiol, 2,5-dibromobenzenethiol, 3,5-dibromobenzenethiol, 2-chloro-5-bromobenzenethiol, 2,4,6-trichlorobenzenethiol, 2,3,4,5,6-pentachlorobenzenethiol, 2,3,4,5,6-pentafluorobenzenethiol, 4-cyanobenzenethiol, 2-cyanobenzenethiol, 4-nitrobenzenethiol, and 2-nitrobenzenethiol.

Examples of disulfide type compounds include diphenyl disulfide, bis(4-chlorophenyl)disulfide, bis(3-chlorophenyl) disulfide, bis(4-bromophenyl)disulfide, bis(3-bromophenyl) disulfide, bis(4-fluorophenyl)disulfide, bis(4-iodophenyl)

disulfide, bis(4-cyanophenyl)disulfide, bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide, bis(2,4,6-trichlorophenyl)disulfide, bis(2-cyano-4-chloro-6-bromophenyl)disulfide, bis(2,3,5,6-tetrachlorophenyl)disulfide, bis(2,3,4,5,6-pentachlorophenyl)disulfide, and bis(2,3,4,5,6-pentabromophenyl)disulfide.

From the standpoint that the core 4 having an appropriate hardness distribution is obtained, particularly preferable organic sulfur compounds are 1-naphthalenethiol and 2-naphthalenethiol. The molecular weight of each of 1-naphthalenethiol and 2-naphthalenethiol is 160.2. The melting point of 2-naphthalenethiol is 79° C. to 81° C.

The most preferable organic sulfur compound is 2-naphthalenethiol. The chemical formula of 2-naphthalenethiol is shown below.

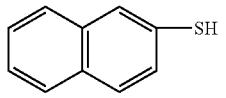

From the standpoint that the core 4 having an appropriate hardness distribution is obtained, the amount of the organic sulfur compound is preferably equal to or greater than 0.03 parts by weight, more preferably equal to or greater than 0.05 parts by weight, and particularly preferably equal to or greater than 0.08 parts by weight, per 100 parts by weight of the base rubber. In light of resilience performance, the amount of the organic sulfur compound is preferably equal to or less than 3.5 parts by weight, more preferably equal to or less than 3.0 parts by weight, and particularly preferably equal to or less than 2.0 parts by weight, per 100 parts by weight of the base rubber.

For the purpose of adjusting specific gravity and the like, a filler may be included in the core 4. Examples of suitable fillers include zinc oxide, barium sulfate, calcium carbonate, and magnesium carbonate. The amount of the filler is determined as appropriate so that the intended specific gravity of the core 4 is accomplished. A particularly preferable filler is zinc oxide. Zinc oxide serves not only as a specific gravity adjuster but also as a crosslinking activator.

According to need, an anti-aging agent, a coloring agent, a plasticizer, a dispersant, sulfur, an vulcanization accelerator, and the like are added to the rubber composition of the core 4. Crosslinked rubber powder or synthetic resin powder may also be dispersed in the rubber composition.

The core 4 has a diameter of preferably 38.0 mm or greater but 42.0 mm or less. The core 4 having a diameter of 38.0 mm or greater can achieve excellent resilience performance of the golf ball 2. The core 4 having a diameter of 38.0 mm or greater can achieve an outer-heavy/inner-light structure of the golf ball 2. In this respect, the diameter is more preferably equal to or greater than 39.0 mm and particularly preferably equal to or greater than 39.5 mm. In the golf ball 2 that includes the core 4 having a diameter of 42.0 mm or less, the mid layer 6 and the cover 10 can have sufficient thicknesses. The golf ball 2 that includes the mid layer 6 and the cover 10 having large thicknesses has excellent durability. In this respect, the diameter is more preferably equal to or less than 41 mm and particularly preferably equal to or less than 40 mm. The core 4 may have two or more layers.

For the mid layer 6, a resin composition is suitably used. Examples of the base polymer of the resin composition include ionomer resins, styrene block-containing thermoplastic elastomers, thermoplastic polyester elastomers, thermoplastic polyamide elastomers, and thermoplastic polyolefin elastomers.

Particularly preferable base polymers are ionomer resins. The golf ball 2 that includes the mid layer 6 including an ionomer resin has excellent resilience performance. An ionomer resin and another resin may be used in combination for the mid layer 6. In this case, the principal component of the base polymer is preferably the ionomer resin. Specifically, the proportion of the ionomer resin to the entire base polymer is preferably equal to or greater than 50% by weight, more preferably equal to or greater than 60% by weight, and particularly preferably equal to or greater than 70% by weight.

Examples of preferable ionomer resins include binary copolymers formed with an α-olefin and an α,β-unsaturated carboxylic acid having 3 to 8 carbon atoms. A preferable binary copolymer includes 80% by weight or more and 90% by weight or less of an α-olefin, and 10% by weight or more and 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more and 85% by weight or less of an α-olefin, 5% by weight or more and 30% by weight or less of an α,β-unsaturated carboxylic acid, and 1% by weight or more and 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329", "Himilan MK7320", and "Himilan MK7329", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation.

Two or more ionomer resins may be used in combination for the mid layer 6. An ionomer resin neutralized with a monovalent metal ion, and an ionomer resin neutralized with a bivalent metal ion may be used in combination.

A preferable resin that can be used in combination with an ionomer resin is a styrene block-containing thermoplastic elastomer. The styrene block-containing thermoplastic elastomer has excellent compatibility with ionomer resins. A resin composition including the styrene block-containing thermoplastic elastomer has excellent fluidity.

The styrene block-containing thermoplastic elastomer includes a polystyrene block as a hard segment, and a soft segment. A typical soft segment is a diene block. Examples of diene compounds include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomers include alloys of olefin and one or more members selected from the group consisting of SBS, SIS, SIBS, SEBS, SEPS, SEEPS, and hydrogenated products thereof. The olefin component in the alloy is presumed to contribute to improvement of compatibility with ionomer resins. Use of this alloy improves the resilience performance of the golf ball 2. An olefin having 2 to 10 carbon atoms is preferably used. Examples of suitable olefins include ethylene, propylene, butene, and pentene. Ethylene and propylene are particularly preferred.

Specific examples of polymer alloys include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N", and "Rabalon SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "Septon HG-252" manufactured by Kuraray Co., Ltd.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the resin composition of the mid layer 6 in an adequate amount.

From the standpoint that an outer-hard/inner-soft structure can be achieved in the sphere consisting of the core 4 and the mid layer 6, the mid layer 6 has a hardness H2 of preferably 47 or greater, more preferably 58 or greater, and particularly preferably 63 or greater. In light of feel at impact of the golf ball 2, the hardness H2 is preferably equal to or less than 70 and particularly preferably equal to or less than 68. The hardness H2 is measured according to the standards of "ASTM-D 2240-68" with a Shore D type hardness scale mounted to an automated rubber hardness measurement machine (trade name "P1", manufactured by Kobunshi Keiki Co., Ltd.). For the measurement, a slab that is formed by hot press and that has a thickness of about 2 mm is used. A slab kept at 23° C. for two weeks is used for the measurement. At the measurement, three slabs are stacked. A slab formed from the same resin composition as the resin composition of the mid layer 6 is used.

From the standpoint that an outer-hard/inner-soft structure can be achieved in the sphere, the hardness H2 of the mid layer 6 is preferably greater than the Shore D hardness at the surface of the core 4. The Shore D hardness at the surface of the core 4 is measured by pressing a Shore D type hardness scale against the surface of the core 4. For the measurement, an automated rubber hardness measurement machine (trade name "P1", manufactured by Kobunshi Keiki Co., Ltd.), to which this hardness scale is mounted, is used.

The mid layer 6 has a thickness of preferably 0.5 mm or greater but 1.5 mm or less. In the sphere that includes the mid layer 6 having a thickness of 0.5 mm or greater, the spin suppression effect provided by the outer-hard/inner-soft structure is great. In this respect, the thickness is more preferably equal to or greater than 0.7 mm and particularly preferably equal to or greater than 0.8 mm. The golf ball 2 that includes the mid layer 6 having a thickness of 1.5 mm or less can include a large core 4. The large core 4 can contribute to the resilience performance of the golf ball 2. In this respect, the thickness is particularly preferably equal to or less than 1.2 mm.

For forming the mid layer 6, known methods such as injection molding, compression molding, and the like can be used. The mid layer 6 may be composed of two or more layers.

A resin composition is suitably for the cover 10. A preferable base polymer of the resin composition is a thermoplastic polyurethane elastomer. The thermoplastic polyurethane elastomer is flexible. When the golf ball 2 that includes the cover 10 formed from this elastomer is hit with a short iron, the spin rate is high. The cover 10 formed from this elastomer contributes to controllability upon a shot with a short iron. This elastomer also contributes to the scuff resistance of the cover 10. Further, this elastomer can achieve excellent feel at impact when the golf ball 2 is hit with a putter or a short iron.

The thermoplastic polyurethane elastomer includes a polyurethane component as a hard segment, and a polyester component or a polyether component as a soft segment. Examples of isocyanates for the polyurethane component include alicyclic diisocyanates, aromatic diisocyanates, and aliphatic diisocyanates. Two or more diisocyanates may be used in combination.

Examples of alicyclic diisocyanates include 4,4'-dicyclohexylmethane diisocyanate ($H_{12}MDI$), 1,3-bis(isocyanatomethyl)cyclohexane ($H_6XDI$), isophorone diisocyanate (IPDI), and trans-1,4-cyclohexane diisocyanate (CHDI). In light of versatility and processability, $H_{12}MDI$ is preferred.

Examples of aromatic diisocyanates include 4,4'-diphenylmethane diisocyanate (MDI) and toluene diisocyanate (TDI). Examples of aliphatic diisocyanates include hexamethylene diisocyanate (HDI).

Particularly, alicyclic diisocyanates are preferred. Since an alicyclic diisocyanate does not have any double bond in the main chain, the alicyclic diisocyanate suppresses yellowing of the cover 10. In addition, since an alicyclic diisocyanate has excellent strength, the alicyclic diisocyanate suppresses a scuff on the cover 10.

Specific examples of thermoplastic polyurethanes include trade names "Elastollan XNY80A", "Elastollan XNY82A", "Elastollan XNY85A", "Elastollan XNY90A", "Elastollan XNY97A", "Elastollan XNY585", and "Elastollan XKP016N", manufactured by BASF Japan Ltd.; and trade names "RESAMINE P4585LS" and "RESAMINE PS62490", manufactured by Dainichiseika Color & Chemicals Mfg. Co., Ltd. From the standpoint that a low hardness of the cover 10 can be achieved, "Elastollan XNY80A", "Elastollan XNY82A", "Elastollan XNY85A", and "Elastollan XNY90A" are particularly preferred.

A thermoplastic polyurethane elastomer and another resin may be used in combination. Examples of the resin that can be used in combination include thermoplastic polyester elastomers, thermoplastic polyamide elastomer, thermoplastic polyolefin elastomers, styrene block-containing thermoplastic elastomers, and ionomer resins. When a thermoplastic polyurethane elastomer and another resin are used in combination, the thermoplastic polyurethane elastomer is included as the principal component of the base polymer, in light of spin performance and scuff resistance. The proportion of the thermoplastic polyurethane elastomer to the entire base polymer is preferably equal to or greater than 50% by weight, more preferably equal to or greater than 70% by weight, and particularly preferably equal to or greater than 85% by weight.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 10 in an adequate amount.

The cover 10 has a Shore D hardness H3 of preferably 47 or less. The golf ball 2 that includes the cover 10 having a hardness H3 of 47 or less has excellent controllability. In this respect, the hardness H3 is more preferably equal to or less than 36 and particularly preferably equal to or less than 29. In light of flight distance upon a shot with a driver, the hardness H3 is preferably equal to or greater than 20. The hardness H3 is measured by the same measurement method as that for the hardness H2.

The Shore D hardness H2 of the mid layer 6 and the Shore D hardness H3 of the cover 10 satisfy the relation of the following mathematical formula.

$$H2>H3$$

When the golf ball 2 is hit with a driver, a long iron, or a middle iron, the sphere consisting of the core 4 and the mid layer 6 becomes significantly distorted since the head speed is high. Since this sphere has an outer-hard/inner-soft structure, the spin rate is suppressed. The suppression of the spin rate achieves a large flight distance. When the golf ball 2 is hit with a short iron, this sphere becomes less distorted since the head speed is low. When the golf ball 2 is hit with a short iron, the behavior of the golf ball 2 mainly depends on the cover 10. Since the cover 10 including the polyurethane is flexible, a high spin rate is obtained. The high spin rate achieves excellent controllability. In the golf ball 2, both desired flight performance upon shots with a driver, a long iron, and a middle iron and desired controllability upon a shot with a short iron are achieved.

When the golf ball 2 is hit, the cover 10 including the polyurethane absorbs the shock. This absorption achieves soft feel at impact. Particularly, when the golf ball 2 is hit with a short iron or a putter, the cover 10 achieves excellent feel at impact.

In light of achievement of both desired flight performance and desired controllability, the difference (H2−H3) between the hardness H2 and the hardness H3 is preferably equal to or greater than 18, more preferably equal to or greater than 29, and particularly preferably equal to or greater than 30. The difference (H2−H3) is preferably equal to or less than 70.

In light of flight performance upon a shot with a driver, the cover 10 has a thickness of preferably 0.8 mm or less, more preferably 0.6 mm or less, and particularly preferably 0.4 mm or less. In light of controllability upon a shot with a short iron, the thickness is preferably equal to or greater than 0.05 mm and particularly preferably equal to or greater than 0.10 mm.

For forming the cover 10, known methods such as injection molding, compression molding, and the like can be used. When forming the cover 10, the dimples 12 are formed by pimples formed on the cavity face of a mold.

The reinforcing layer 8 is positioned between the mid layer 6 and the cover 10. The reinforcing layer 8 firmly adheres to the mid layer 6 and also to the cover 10. The reinforcing layer 8 suppresses separation of the cover 10 from the mid layer 6. As described above, the cover 10 of the golf ball 2 is thin. When the golf ball 2 is hit by the edge of a clubface, a wrinkle is likely to occur. The reinforcing layer 8 suppresses occurrence of a wrinkle.

As the base polymer of the reinforcing layer 8, a two-component curing type thermosetting resin is suitably used. Specific examples of two-component curing type thermosetting resins include epoxy resins, urethane resins, acrylic resins, polyester resins, and cellulose resins. In light of strength and durability of the reinforcing layer 8, two-component curing type epoxy resins and two-component curing type urethane resins are preferred.

A two-component curing type epoxy resin is obtained by curing an epoxy resin with a polyamide type curing agent. Examples of epoxy resins used in two-component curing type epoxy resins include bisphenol A type epoxy resins, bisphenol F type epoxy resins, and bisphenol AD type epoxy resins. A bisphenol A type epoxy resin is obtained by a reaction of bisphenol A and an epoxy group-containing compound such as epichlorohydrin or the like. A bisphenol F type epoxy resin is obtained by a reaction of bisphenol F and an epoxy group-containing compound. A bisphenol AD type epoxy resin is obtained by a reaction of bisphenol AD and an epoxy group-containing compound. In light of balance among flexibility, chemical resistance, heat resistance, and toughness, bisphenol A type epoxy resins are preferred.

The polyamide type curing agent has a plurality of amino groups and one or more amide groups. The amino groups can react with epoxy groups. Specific examples of the polyamide type curing agent include polyamide amine curing agents and modified products thereof. A polyamide amine curing agent is obtained by a condensation reaction of a polymerized fatty acid and a polyamine. A typical polymerized fatty acid is obtained by heating and combining natural fatty acids including a large amount of unsaturated fatty acids, such as linoleic acid, linolenic acid, and the like, in the presence of a catalyst. Specific examples of unsaturated fatty acids include tall oil, soybean oil, linseed oil, and fish oil. A hydrogenated polymerized fatty acid having a dimer content of 90% by weight or greater and a trimer content of 10% by weight or less is preferred. Examples of preferable polyamines include polyethylene diamines, polyoxyalkylene diamines, and derivatives thereof.

In a mixture of an epoxy resin and a polyamide type curing agent, the ratio of the epoxy equivalent of the epoxy resin to the amine active hydrogen equivalent of the polyamide type curing agent is preferably equal to or greater than 1.0/1.4 but equal to or less than 1.0/1.0.

A two-component curing type urethane resin is obtained by a reaction of a base material and a curing agent. A two-component curing type urethane resin obtained by a reaction of a base material containing a polyol component and a curing agent containing a polyisocyanate or a derivative thereof, and a two-component curing type urethane resin obtained by a reaction of a base material containing an isocyanate group-terminated urethane prepolymer and a curing agent having active hydrogen, can be used. Particularly, a two-component curing type urethane resin obtained by a reaction of a base material containing a polyol component and a curing agent containing a polyisocyanate or a derivative thereof, is preferred.

As the polyol component of the base material, a urethane polyol is preferably used. The urethane polyol has a urethane bond and at least two or more hydroxyl groups. Preferably, the urethane polyol has hydroxyl groups at its ends. The urethane polyol can be obtained by causing a reaction of a polyol and a polyisocyanate at such a ratio that the hydroxyl groups of the polyol component are excessive in mole ratio with respect to the isocyanate groups of the polyisocyanate.

The polyol for producing the urethane polyol has a plurality of hydroxyl groups. Polyols having a weight average molecular weight of 50 or greater but 2000 or less are preferred, and polyols having a weight average molecular weight of 100 or greater but 1000 or less are particularly preferred. Examples of low-molecular-weight polyols include diols and triols. Specific examples of diols include ethylene glycol, diethylene glycol, triethylene glycol, 1,3-butanediol, 1,4-butanediol, neopentyl glycol, and 1,6-hexanediol. Specific examples of triols include trimethylol propane and hexanetriol. Examples of high-molecular-weight polyols include polyether polyols such as polyoxyethylene glycol (PEG), polyoxypropylene glycol (PPG), and polyoxytetramethylene glycol (PTMG); condensed polyester polyols such as polyethylene adipate (PEA), polybutylene adipate (PBA), and polyhexamethylene adipate (PHMA); lactone polyester polyols such as poly-E-caprolactone (PCL); polycarbonate polyols such as polyhexamethylene carbonate; and acrylic polyols. Two or more polyols may be used in combination.

The polyisocyanate for producing the urethane polyol has a plurality of isocyanate groups. Specific examples of the polyisocyanate include aromatic polyisocyanates such as 2,4-toluene diisocyanate, 2,6-toluene diisocyanate, a mixture (TDI) of 2,4-toluene diisocyanate and 2,6-toluene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and paraphenylene diisocyanate (PPDI); alicyclic polyisocyanates such as 4-4'-dicyclohexylmethane diisocyanate ($H_{12}$MDI), hydrogenated xylylene diisocyanate ($H_6$XDI), and isophorone diisocyanate (IPDI); and aliphatic polyisocyanates such as hexamethylene diisocyanate (HDI). Two or more of these polyisocyanates may be used in combination. In light of weather resistance, TMXDI, XDI, HDI, $H_6$XDI, IPDI, and $H_{12}$MDI are preferred.

In the reaction of the polyol and the polyisocyanate for producing the urethane polyol, a known catalyst can be used. A typical catalyst is dibutyl tin dilaurate.

In light of strength of the reinforcing layer 8, the proportion of the urethane bonds included in the urethane polyol is preferably equal to or greater than 0.1 mmol/g. In light of followability of the reinforcing layer 8 to the cover 10, the proportion of the urethane bonds included in the urethane polyol is preferably equal to or less than 5 mmol/g. The proportion of the urethane bonds can be adjusted by adjusting the molecular weight of the polyol, which is the material for the urethane polyol, and adjusting the blending ratio of the polyol and the polyisocyanate.

From the standpoint that a time taken for the reaction of the base material and the curing agent is short, the weight average molecular weight of the urethane polyol is preferably equal to or greater than 4000 and particularly preferably equal to or greater than 4500. In light of adhesion of the reinforcing layer 8, the weight average molecular weight of the urethane polyol is preferably equal to or less than 10000 and particularly preferably equal to or less than 9000.

In light of adhesion of the reinforcing layer 8, the hydroxyl value (mg KOH/g) of the urethane polyol is preferably equal to or greater than 15 and particularly preferably equal to or greater than 73. From the standpoint that a time taken for the reaction of the base material and the curing agent is short, the hydroxyl value of the urethane polyol is preferably equal to or less than 130 and particularly preferably equal to or less than 120.

The base material may contain, together with a urethane polyol, a polyol that does not have any urethane bond. The aforementioned polyol that is the material for the urethane polyol can be used in the base material. Polyols compatible with the urethane polyol are preferred. From the standpoint that a time taken for the reaction of the base material and the curing agent is short, the proportion of the urethane polyol in the base material on the solid content basis is preferably equal to or greater than 50% by weight and particularly preferably equal to or greater than 80% by weight. Ideally, the proportion is 100% by weight.

The curing agent contains a polyisocyanate or a derivative thereof. The aforementioned polyisocyanate that is the material for the urethane polyol can be used in the curing agent.

The reinforcing layer 8 may include additives such as a coloring agent (typically, titanium dioxide), a phosphate-based stabilizer, an antioxidant, a light stabilizer, a fluorescent brightener, an ultraviolet absorber, an anti-blocking agent, and the like. The additives may be added to the base material of the two-component curing type thermosetting resin, or may be added to the curing agent of the two-component curing type thermosetting resin.

The reinforcing layer 8 is obtained by applying, to the surface of the mid layer 6, a liquid that is prepared by dissolving or dispersing the base material and the curing agent in a solvent. In light of workability, application with a spray gun is preferred. After the application, the solvent is volatilized to permit a reaction of the base material with the curing agent, thereby forming the reinforcing layer 8. Examples of preferable solvents include toluene, isopropyl alcohol, xylene, methyl ethyl ketone, methyl isobutyl ketone, ethylene glycol monomethyl ether, ethylbenzene, propylene glycol monomethyl ether, isobutyl alcohol, and ethyl acetate.

In light of feel at impact, the golf ball 2 has an amount of compressive deformation CD of preferably 2.5 mm or more, more preferably 2.7 mm or more, and particularly preferably 2.8 mm or more. In light of resilience performance, the amount of compressive deformation CD is preferably equal to or less than 4.0 mm, more preferably equal to or less than 3.8 mm, and particularly preferably equal to or less than 3.6 mm.

At measurement of the amount of compressive deformation, first, the golf ball 2 is placed on a hard plate made of metal. Next, a cylinder made of metal gradually descends toward the golf ball 2. The golf ball 2, squeezed between the bottom face of the cylinder and the hard plate, becomes deformed. A migration distance of the cylinder, starting from the state in which an initial load of 98 N is applied to the golf ball 2 up to the state in which a final load of 1274 N is applied thereto, is measured.

EXAMPLES

Example 1

A rubber composition was obtained by kneading 100 parts by weight of a high-cis polybutadiene (trade name "BR-730", manufactured by JSR Corporation), 29.0 parts by weight of zinc diacrylate, 5 parts by weight of zinc oxide, 12.3 parts by weight of barium sulfate, 0.2 parts by weight of 2-naphthalenethiol, and 0.8 parts by weight of dicumyl peroxide. This rubber composition was placed into a mold including upper and lower mold halves each having a hemispherical cavity, and heated at 170° C. for 25 minutes to obtain a core with a diameter of 39.9 mm.

A resin composition was obtained by kneading 55 parts by weight of an ionomer resin (the aforementioned "Surlyn 8945"), 45 parts by weight of another ionomer resin (the aforementioned "Himilan AM7329"), and 3 parts by weight of titanium dioxide with a twin-screw kneading extruder. The core was placed into a mold. The core was covered with the resin composition by injection molding to form a mid layer with a thickness of 1.0 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium oxide. The weight ratio of the base material liquid to the curing agent liquid is 1/1. This paint composition was applied to the surface of the mid layer with a spray gun, and kept at 40° C. for 24 hours to obtain a reinforcing layer with a thickness of 10 μm.

A resin composition was obtained by kneading 100 parts by weight of a thermoplastic polyurethane elastomer (the aforementioned "Elastollan XNY82A"), 0.2 parts by weight of a hindered amine light stabilizer (trade name "TINUVIN 770", manufactured by Ciba Japan K.K.), 4 parts by weight of titanium dioxide, and 0.04 parts by weight of ultramarine blue with a twin-screw kneading extruder. Half shells were formed from this resin composition by compression molding. The sphere consisting of the core, the mid layer, and the reinforcing layer was covered with two of these half shells. The sphere and the half shells were placed into a final mold that includes upper and lower mold halves each having a hemispherical cavity and that has a large number of pimples on its cavity face. A cover was obtained by compression molding. The cover had a thickness of 0.4 mm. Dimples having a shape that is the inverted shape of the pimples were formed on the cover. A clear paint including a two-component curing type polyurethane as a base material was applied to this cover to obtain a golf ball of Example 1 with a diameter of 42.7 mm.

Examples 2 to 12 and Comparative Examples 1 to 3 and 5 to 8

Golf balls of Examples 2 to 12 and Comparative Examples 1 to 3 and 5 to 8 were obtained in the same manner as Example 1, except the specifications of the core, the mid layer, and the cover were as shown in Tables 4 to 7 below.

Comparative Example 4

A rubber composition was obtained by kneading 100 parts by weight of a high-cis polybutadiene (the aforementioned "BR-730"), 23.5 parts by weight of zinc diacrylate, 5 parts by weight of zinc oxide, 14.5 parts by weight of barium sulfate, 0.5 parts by weight of diphenyl disulfide, and 0.8 parts by weight of dicumyl peroxide. This rubber composition was placed into a mold including upper and lower mold halves each having a hemispherical cavity, and heated at 170° C. for 25 minutes to obtain a center with a diameter of 25.0 mm.

A rubber composition was obtained by kneading 100 parts by weight of a high-cis polybutadiene (the aforementioned "BR-730"), 35 parts by weight of zinc diacrylate, 5 parts by weight of zinc oxide, 9.8 parts by weight of barium sulfate, 0.5 parts by weight of diphenyl disulfide, and 0.8 parts by weight of dicumyl peroxide. Half shells were formed from this rubber composition. The center was covered with two half shells. The center and the half shells were placed into a mold including upper and lower mold halves each having a hemispherical cavity, and heated at 170° C. for 25 minutes to obtain a core with a diameter of 39.9 mm. The core consists of the center and an envelope layer. The core was covered with a mid layer, a reinforcing layer, and a cover in the same manner as Example 1. Further, a clear paint was applied in the same manner as Example 1 to obtain a golf ball of Comparative Example 4.

[Flight Test]

A driver with a titanium head (trade name "XXIO", manufactured by SRI Sports Limited, shaft hardness: S, loft angle: 10.0°) was attached to a swing machine manufactured by True Temper Co. A golf ball was hit under the condition of a head speed of 45 m/sec. The ball speed and the spin rate were measured immediately after the hit. Further, the distance from the launch point to the stop point was measured. The average value of data obtained by 10 measurements is shown in Tables 8 to 11 below.

[Spin Rate]

A sand wedge (SW) was attached to a swing machine manufactured by True Temper Co. A golf ball was hit under the condition of a head speed of 21 m/sec. The spin rate was measured immediately after the hit. The average value of data obtained by 10 measurements is shown in Tables 8 to 11 below.

[Durability Test]

A golf ball was kept in the environment of 23° C. for 12 hours. A driver with a titanium head (trade name "XXIO", manufactured by SRI Sports Limited, shaft hardness: S, loft angle: 10.0°) was attached to a swing machine manufactured by True Temper Co. The golf ball was repeatedly hit under the condition of a head speed of 45 m/sec. The number of hits required to break the golf ball was counted. An index of the average value of data obtained by 12 measurements is shown in Tables 8 to 11 below. A greater index indicates a better result.

TABLE 1

| Composition of Core (parts by weight) | | | | | | |
|---|---|---|---|---|---|---|
| Type | 1 | 2 | 3 | 4 | 5 | 6 |
| Polybutadiene | 100 | 100 | 100 | 100 | 100 | 100 |
| Zinc diacrylate | 30 | 29 | 39 | 27 | 45 | 26 |

TABLE 1-continued

| Composition of Core (parts by weight) | | | | | | |
|---|---|---|---|---|---|---|
| Type | 1 | 2 | 3 | 4 | 5 | 6 |
| Zinc oxide | 5 | 5 | 5 | 5 | 5 | 5 |
| Barium sulfate | 11.8 | 12.3 | 7.5 | 13.2 | 4.5 | 13.6 |
| Diphenyl disulfide | 0.5 | — | — | — | — | — |
| 2-naphthalenethiol | — | 0.2 | 2.0 | 0.08 | 3.5 | 0.03 |
| Dicumyl peroxide | 0.8 | 0.8 | 0.8 | 0.8 | 0.8 | 0.8 |

TABLE 2

| Composition of Core (parts by weight) | | | | | | |
|---|---|---|---|---|---|---|
| Type | 7 | 8 | 9 | 10 | 11 | 12 |
| Polybutadiene | 100 | 100 | 100 | 100 | 100 | 100 |
| Zinc diacrylate | 27 | 32 | 23.5 | 35 | 41 | 29 |
| Zinc oxide | 5 | 5 | 5 | 5 | 5 | 5 |
| Barium sulfate | 13.2 | 11 | 14.5 | 9.8 | 7 | 12.3 |
| Diphenyl disulfide | — | — | 0.5 | 0.5 | — | — |
| 2-naphthalenethiol | 0.2 | — | — | — | — | — |
| Pentachlorothiophenol | — | 0.6 | — | — | — | — |
| Dicumyl peroxide | 0.8 | 0.8 | 0.8 | 0.8 | — | 1.5 |
| 1,1-di(t-butylperoxy) cyclohexane | — | — | — | — | 3.0 | — |
| 2,2'-methylenebis(4-methyl-6-t-butylphenol) | — | — | — | — | 0.1 | 0.5 |
| Zinc stearate | — | — | — | — | 5.0 | — |
| Sulfur | — | — | — | — | 0.1 | — |
| Zinc salt of pentachlorothiophenol | — | — | — | — | 0.5 | — |

The details of the compounds listed in Tables 1 and 2 are as follows.

Diphenyl disulfide: Sumitomo Seika Chemicals Co., Ltd.

2-naphthalenethiol: Tokyo Chemical Industry Co., Ltd.

Pentachlorothiophenol: Tokyo Chemical Industry Co., Ltd.

Dicumyl peroxide: NOF Corporation.

1,1-di(t-butylperoxy)cyclohexane: trade name "Perhexa C-40", manufactured by NOF Corporation.

2,2'-methylenebis(4-methyl-6-t-butylphenol): trade name "Nocrac NS-6", manufactured by Ouchi Shinko Chemical Industrial Co., Ltd.

Zinc stearate: NOF Corporation.

Sulfur: trade name "Sulfur Z", manufactured by Tsurumi Chemical Industry Co., Ltd.

TABLE 3

| Compositions of Mid Layer and Cover (parts by weight) | | | | | | |
|---|---|---|---|---|---|---|
| | A | B | C | D | E | F |
| Surlyn 8945 | 55 | 47 | 25 | — | — | — |
| Himilan AM7329 | 45 | 45 | 45 | — | — | — |
| Rabalon T3221C | — | 8 | 30 | — | — | — |
| Elastollan XNY82A | — | — | — | 100 | — | — |
| Elastollan XNY85A | — | — | — | — | 50 | — |
| Elastollan XNY90A | — | — | — | — | 50 | — |
| Elastollan XNY97A | — | — | — | — | — | 100 |
| TINUVIN 770 | — | — | — | 0.2 | 0.2 | 0.2 |
| Titanium dioxide | 3 | 3 | 3 | 4 | 4 | 4 |
| Ultramarine blue | — | — | — | 0.04 | 0.04 | 0.04 |
| Hardness (Shore D) | 65 | 58 | 47 | 29 | 36 | 47 |

TABLE 4

Figure 3:
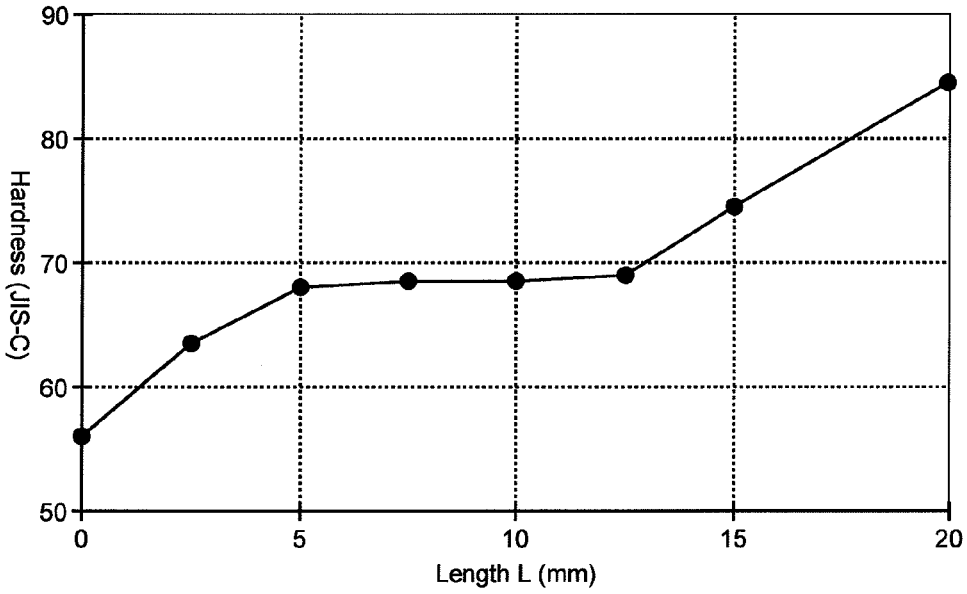
FIG. 3 is a graph showing a hardness distribution of a core of a golf ball according to Example 2 of the present invention.
Figure 4:
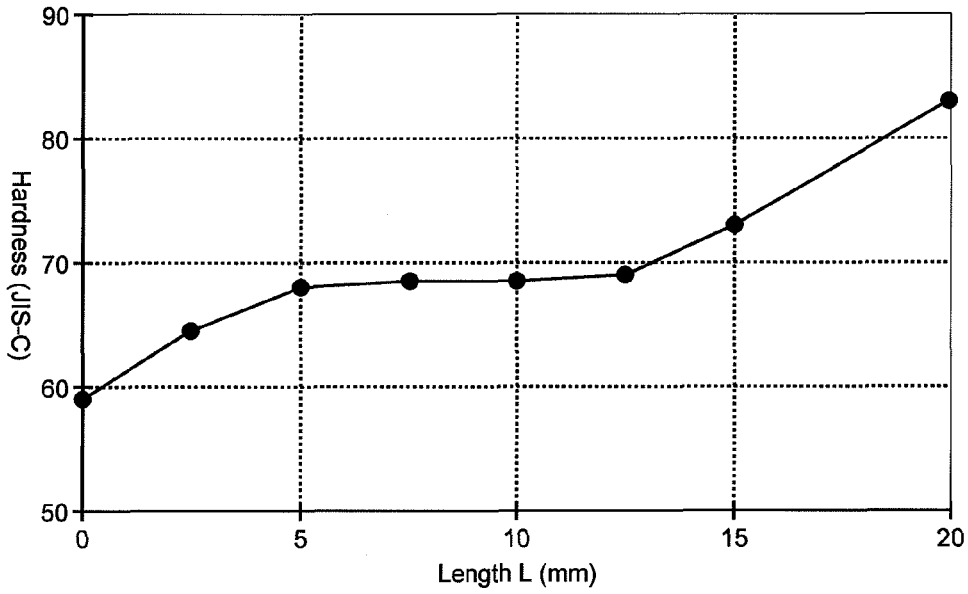
FIG. 4 is a graph showing a hardness distribution of a core of a golf ball according to Example 3 of the present invention.
Figure 5:
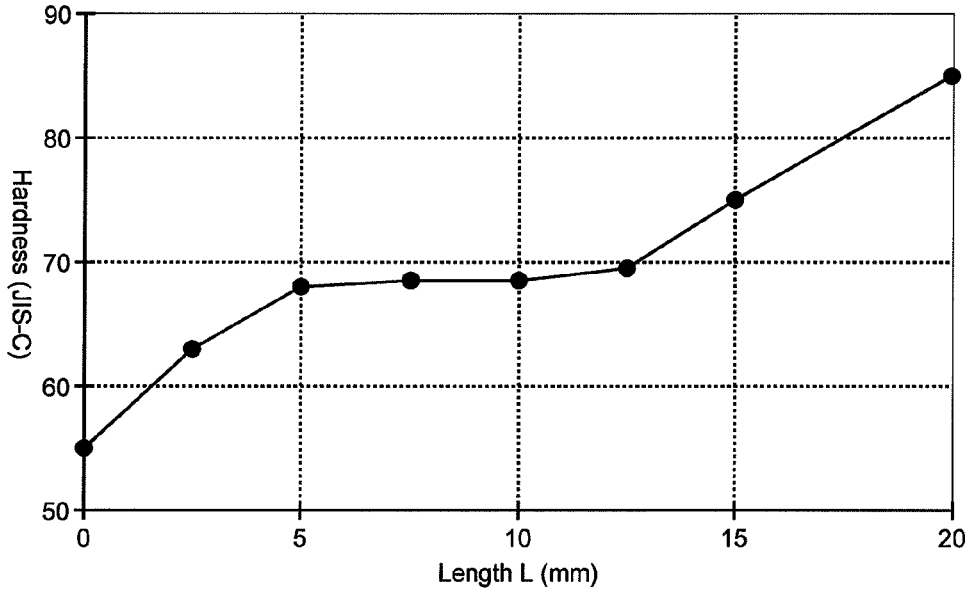
FIG. 5 is a graph showing a hardness distribution of a core of a golf ball according to Example 4 of the present invention.
Figure 6:
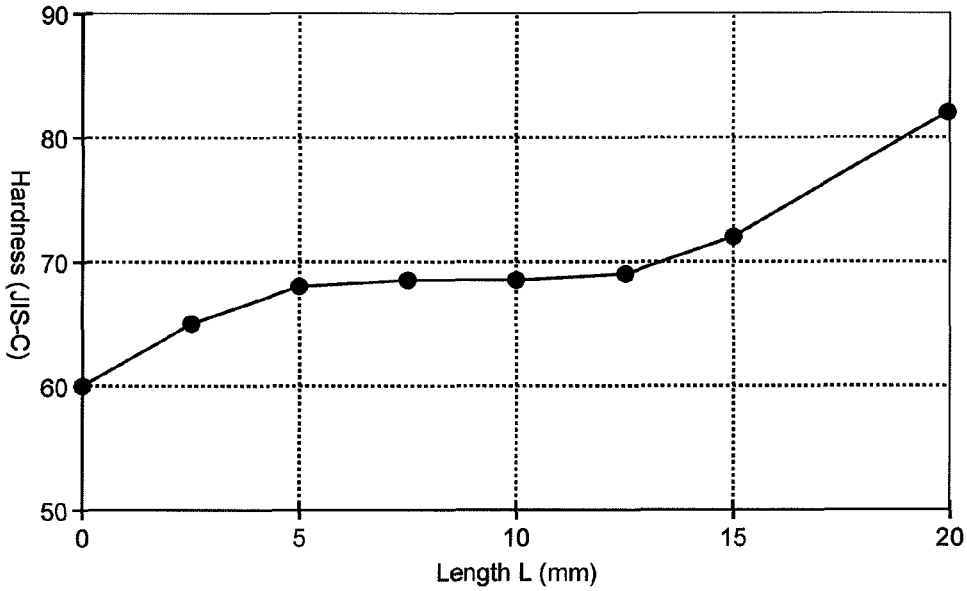
FIG. 6 is a graph showing a hardness distribution of a core of a golf ball according to Example 5 of the present invention.

| Specifications of Golf Ball | | | | | |
|---|---|---|---|---|---|
| | Ex. 1 | Ex. 2 | Ex. 3 | Ex. 4 | Ex. 5 |
| Core | | | | | |
| Composition | 2 | 3 | 4 | 5 | 6 |
| Crosslinking temperature (° C.) | 170 | 170 | 170 | 170 | 170 |
| Crosslinking time (min) | 25 | 25 | 25 | 25 | 25 |
| Diameter (mm) | 39.9 | 39.9 | 39.9 | 39.9 | 39.9 |
| Hardness of core | | | | | |
| Ho | 57.0 | 56.0 | 59.0 | 55.0 | 60.0 |
| H(2.5) | 64.0 | 63.5 | 64.5 | 63.0 | 65.0 |
| H(5.0) | 68.0 | 68.0 | 68.0 | 68.0 | 68.0 |
| H(7.5) | 68.5 | 68.5 | 68.5 | 68.5 | 68.5 |
| H(10.0) | 68.5 | 68.5 | 68.5 | 68.5 | 68.5 |
| H(12.5) | 69.0 | 69.0 | 69.0 | 69.5 | 69.0 |
| H(12.6) | — | — | — | — | — |
| H(15.0) | 74.0 | 74.5 | 73.0 | 75.0 | 72.0 |
| Hs | 84.0 | 84.5 | 83.0 | 85.0 | 82.0 |
| Graph | FIG. 2 | FIG. 3 | FIG. 4 | FIG. 5 | FIG. 6 |
| Mid layer | | | | | |
| Composition | A | A | A | A | A |
| Hardness H2 (Shore D) | 65 | 65 | 65 | 65 | 65 |
| Thickness (mm) | 1.0 | 1.0 | 1.0 | 1.0 | 1.0 |
| Cover | | | | | |
| Composition | D | D | D | D | D |
| Hardness H3 (Shore D) | 29 | 29 | 29 | 29 | 29 |
| Thickness (mm) | 0.4 | 0.4 | 0.4 | 0.4 | 0.4 |

TABLE 5

| Specifications of Golf Ball | | | | | |
|---|---|---|---|---|---|
| | Ex. 6 | Ex. 7 | Ex. 8 | Ex. 9 | Ex. 10 |
| Core | | | | | |
| Composition | 2 | 2 | 2 | 2 | 2 |
| Crosslinking temperature (° C.) | 170 | 170 | 170 | 170 | 170 |
| Crosslinking time (min) | 25 | 25 | 25 | 25 | 25 |
| Diameter (mm) | 39.9 | 39.9 | 39.9 | 39.9 | 39.9 |
| Hardness of core | | | | | |
| Ho | 57.0 | 57.0 | 57.0 | 57.0 | 57.0 |
| H(2.5) | 64.0 | 64.0 | 64.0 | 64.0 | 64.0 |
| H(5.0) | 68.0 | 68.0 | 68.0 | 68.0 | 68.0 |
| H(7.5) | 68.5 | 68.5 | 68.5 | 68.5 | 68.5 |
| H(10.0) | 68.5 | 68.5 | 68.5 | 68.5 | 68.5 |
| H(12.5) | 69.0 | 69.0 | 69.0 | 69.0 | 69.0 |
| H(12.6) | — | — | — | — | — |
| H(15.0) | 74.0 | 74.0 | 74.0 | 74.0 | 74.0 |
| Hs | 84.0 | 84.0 | 84.0 | 84.0 | 84.0 |
| Graph | FIG. 2 | FIG. 2 | FIG. 2 | FIG. 2 | FIG. 2 |
| Mid layer | | | | | |
| Composition | A | A | B | C | A |
| Hardness H2 (Shore D) | 65 | 65 | 58 | 47 | 65 |
| Thickness (mm) | 1.0 | 1.0 | 1.0 | 1.0 | 1.1 |
| Cover | | | | | |
| Composition | E | F | D | D | D |
| Hardness H3 (Shore D) | 36 | 47 | 29 | 29 | 29 |
| Thickness (mm) | 0.4 | 0.4 | 0.4 | 0.4 | 0.3 |

TABLE 6

Figure 7:
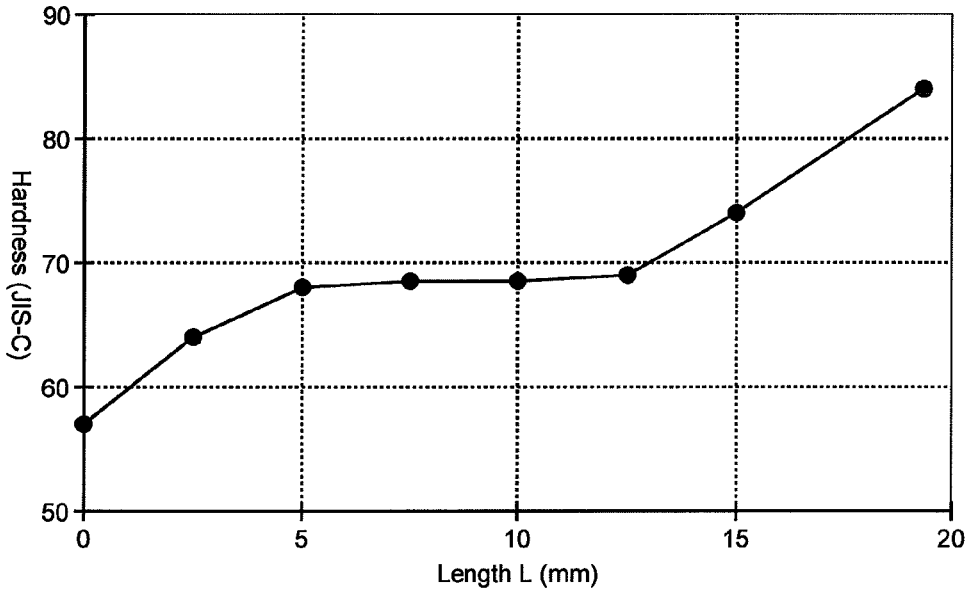
FIG. 7 is a graph showing a hardness distribution of a core of a golf ball according to Example 12 of the present invention.
Figure 8:
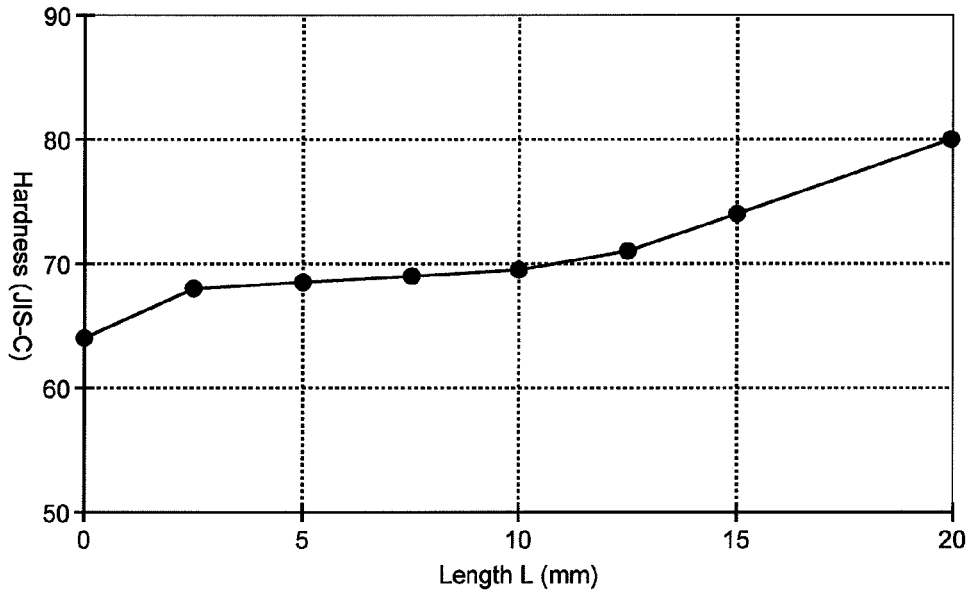
FIG. 8 is a graph showing a hardness distribution of a core of a golf ball according to Comparative Example 1.
Figure 9:
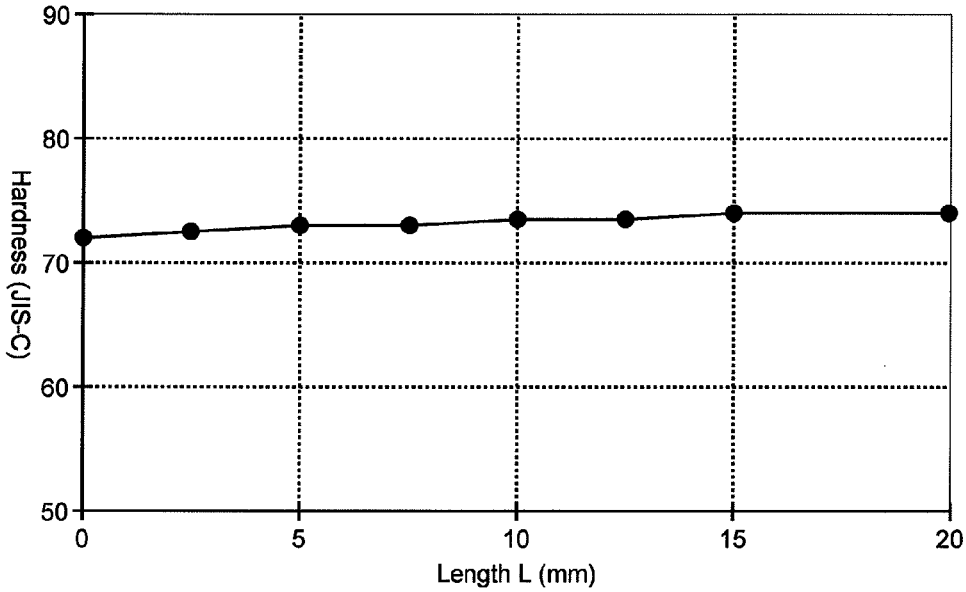
FIG. 9 is a graph showing a hardness distribution of a core of a golf ball according to Comparative Example 2.
Figure 10:
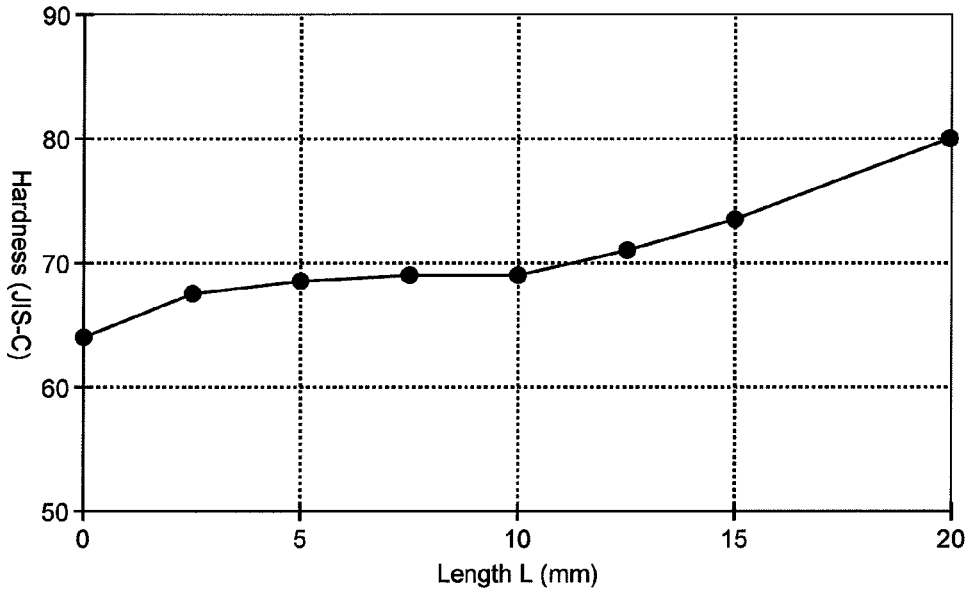
FIG. 10 is a graph showing a hardness distribution of a core of a golf ball according to Comparative Example 3.

| Specifications of Golf Ball | Ex. 11 | Ex. 12 | Com. Ex. 1 | Com. Ex. 2 | Com. Ex. 3 |
|---|---|---|---|---|---|
| Core | | | | | |
| Composition | 2 | 2 | 1 | 7 | 8 |
| Crosslinking temperature (° C.) | 170 | 170 | 170 | 155 | 170 |
| Crosslinking time (min) | 25 | 25 | 25 | 40 | 25 |
| Diameter (mm) | 39.9 | 38.7 | 39.9 | 39.9 | 39.9 |
| Hardness of core | | | | | |
| Ho | 57.0 | 57.0 | 64.0 | 72.0 | 64.0 |
| H(2.5) | 64.0 | 64.0 | 68.0 | 72.5 | 67.5 |
| H(5.0) | 68.0 | 68.0 | 68.5 | 73.0 | 68.5 |
| H(7.5) | 68.5 | 68.5 | 69.0 | 73.0 | 69.0 |
| H(10.0) | 68.5 | 68.5 | 69.5 | 73.5 | 69.0 |
| H(12.5) | 69.0 | 69.0 | 71.0 | 73.5 | 71.0 |
| H(12.6) | — | — | — | — | — |
| H(15.0) | 74.0 | 74.0 | 74.0 | 74.0 | 73.5 |
| Hs | 84.0 | 84.0 | 80.0 | 74.0 | 80.0 |
| Graph | FIG. 2 | FIG. 7 | FIG. 8 | FIG. 9 | FIG. 10 |
| Mid layer | | | | | |
| Composition | A | A | A | A | A |
| Hardness H2 (Shore D) | 65 | 65 | 65 | 65 | 65 |
| Thickness (mm) | 0.9 | 1.0 | 1.0 | 1.0 | 1.0 |
| Cover | | | | | |
| Composition | D | D | D | D | D |
| Hardness H3 (Shore D) | 29 | 29 | 29 | 29 | 29 |
| Thickness (mm) | 0.5 | 1.0 | 0.4 | 0.4 | 0.4 |

TABLE 7

Figure 11:
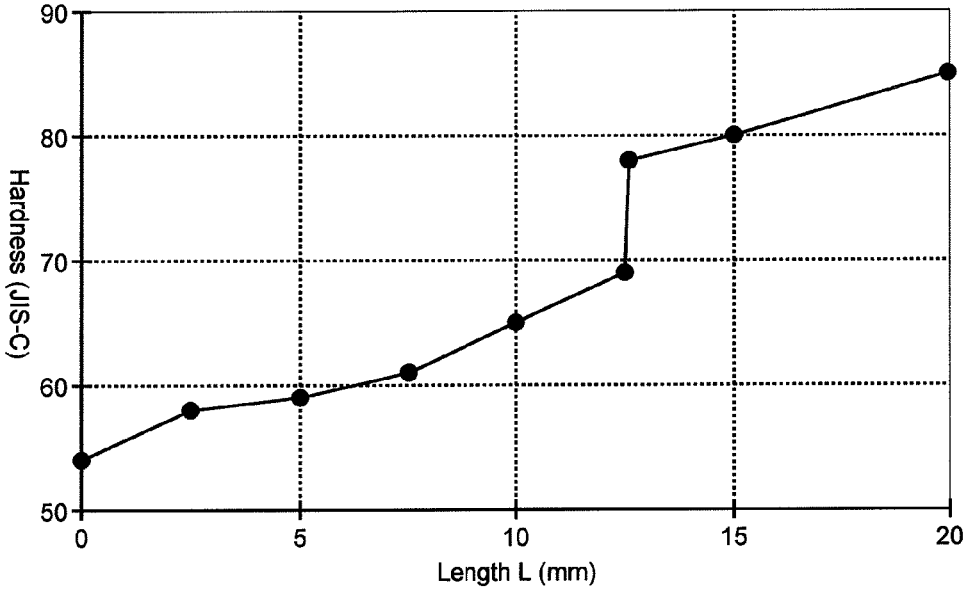
FIG. 11 is a graph showing a hardness distribution of a core of a golf ball according to Comparative Example 4.
Figure 12:
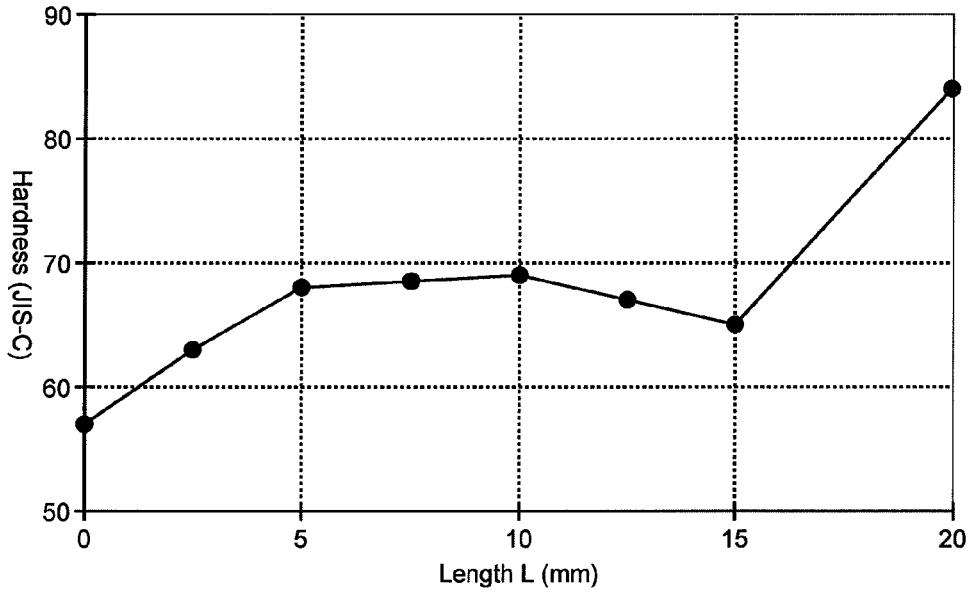
FIG. 12 is a graph showing a hardness distribution of a core of a golf ball according to Comparative Example 5.
Figure 13:
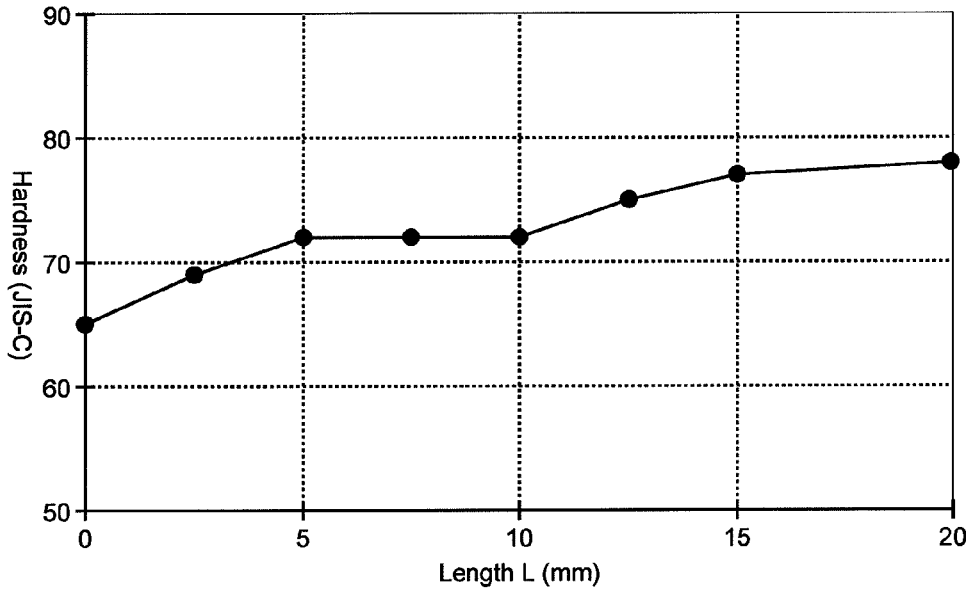
FIG. 13 is a graph showing a hardness distribution of a core of a golf ball according to Comparative Example 6.

| Specifications of Golf Ball | Com. Ex. 4 | | | | | |
|---|---|---|---|---|---|---|
| | Center | Envelope layer | Com. Ex. 5 | Com. Ex. 6 | Com. Ex. 7 | Com. Ex. 8 |
| Core | | | | | | |
| Composition | 9 | 10 | 11 | 12 | 2 | 2 |
| Crosslinking temperature (° C.) | 170 | 170 | 160 | 162 | 170 | 170 |
| Crosslinking time (min) | 25 | 25 | 25 | 23 | 25 | 25 |
| Diameter (mm) | 25.0 | 39.9 | 39.9 | 39.9 | 39.9 | 39.9 |
| Hardness of core | | | | | | |
| Ho | 54.0 | | 57.0 | 65.0 | 57.0 | 57.0 |
| H(2.5) | 58.0 | | 63.0 | 69.0 | 64.0 | 64.0 |
| H(5.0) | 59.0 | | 68.0 | 72.0 | 68.0 | 68.0 |
| H(7.5) | 61.0 | | 68.5 | 72.0 | 68.5 | 68.5 |
| H(10.0) | 65.0 | | 69.0 | 72.0 | 68.5 | 68.5 |
| H(12.5) | 69.0 | | 67.0 | 75.0 | 69.0 | 69.0 |
| H(12.6) | 78.0 | | — | — | — | — |
| H(15.0) | 80.0 | | 65.0 | 77.0 | 74.0 | 74.0 |
| Hs | 85.0 | | 84.0 | 78.0 | 84.0 | 84.0 |
| Graph | FIG. 11 | | FIG. 12 | FIG. 13 | FIG. 2 | FIG. 2 |
| Mid layer | | | | | | |
| Composition | A | | A | A | — | B |
| H2 (Shore D) | 65 | | 65 | 65 | — | 58 |
| Thickness (mm) | 1.0 | | 1.0 | 1.0 | — | 1.0 |
| Cover | | | | | | |

TABLE 7-continued

| Specifications of Golf Ball | Com. Ex. 4 | | | | | |
|---|---|---|---|---|---|---|
| | Center | Envelope layer | Com. Ex. 5 | Com. Ex. 6 | Com. Ex. 7 | Com. Ex. 8 |
| Composition | D | | D | D | A | A |
| H3 (Shore D) | 29 | | 29 | 29 | 65 | 65 |
| Thickness (mm) | 0.4 | | 0.4 | 0.4 | 1.4 | 0.4 |

TABLE 8

| Result of Evaluation | | Ex. 1 | Ex. 2 | Ex. 3 | Ex. 4 | Ex. 5 |
|---|---|---|---|---|---|---|
| H(5.0) − Ho | | 11.0 | 12.0 | 9.0 | 13.0 | 8.0 |
| H(12.5) − H(5.0) | | 1.0 | 1.0 | 1.0 | 1.5 | 1.0 |
| Hs − H(12.5) | | 15.0 | 15.5 | 14.0 | 15.5 | 13.0 |
| Hs − Ho | | 27.0 | 28.5 | 24.0 | 30.0 | 22.0 |
| H2 − H3 | | 36 | 36 | 36 | 36 | 36 |
| Deformation CD (mm) | | 2.9 | 2.9 | 2.9 | 2.9 | 2.9 |
| W#1 | Ball speed (m/s) | 65.7 | 65.6 | 65.6 | 65.4 | 65.5 |
| | Spin rate (rpm) | 3060 | 3030 | 3100 | 3000 | 3180 |
| | Flight distance (m) | 240 | 239 | 238 | 238 | 236 |
| SW | Spin rate (rpm) | 6750 | 6730 | 6760 | 6700 | 6780 |
| Durability | | 98 | 96 | 99 | 95 | 99 |

TABLE 9

| Result of Evaluation | | Ex. 6 | Ex. 7 | Ex. 8 | Ex. 9 | Ex. 10 |
|---|---|---|---|---|---|---|
| H(5.0) − Ho | | 11.0 | 11.0 | 11.0 | 11.0 | 11.0 |
| H(12.5) − H(5.0) | | 1.0 | 1.0 | 1.0 | 1.0 | 1.0 |
| Hs − H(12.5) | | 15.0 | 15.0 | 15.0 | 15.0 | 15.0 |
| Hs − Ho | | 27.0 | 27.0 | 27.0 | 27.0 | 27.0 |
| H2 − H3 | | 29 | 18 | 29 | 18 | 36 |
| Deformation CD (mm) | | 2.9 | 2.8 | 3.0 | 3.1 | 2.8 |
| W#1 | Ball speed (m/s) | 65.8 | 65.9 | 65.5 | 65.3 | 65.9 |
| | Spin rate (rpm) | 3000 | 2900 | 3170 | 3280 | 3000 |
| | Flight distance (m) | 242 | 244 | 236 | 233 | 242 |
| SW | Spin rate (rpm) | 6650 | 6500 | 6950 | 7200 | 6700 |
| Durability | | 98 | 96 | 107 | 128 | 98 |

TABLE 10

| Result of Evaluation | | Ex. 11 | Ex. 12 | Compa. Ex. 1 | Compa. Ex. 2 | Compa. Ex. 3 |
|---|---|---|---|---|---|---|
| H(5.0) − Ho | | 11.0 | 11.0 | 4.5 | 1.0 | 4.5 |
| H(12.5) − H(5.0) | | 1.0 | 1.0 | 2.5 | 0.5 | 2.5 |
| Hs − H(12.5) | | 15.0 | 15.0 | 9.0 | 0.5 | 9.0 |
| Hs − Ho | | 27.0 | 27.0 | 16.0 | 2.0 | 16.0 |
| H2 − H3 | | 36 | 36 | 36 | 36 | 36 |
| Deformation CD (mm) | | 2.9 | 2.9 | 2.9 | 2.9 | 2.9 |
| W#1 | Ball speed (m/s) | 65.6 | 65.3 | 65.4 | 65.9 | 65.4 |
| | Spin rate (rpm) | 3090 | 3200 | 3300 | 3500 | 3330 |
| | Flight distance (m) | 238 | 234 | 232 | 230 | 231 |
| SW | Spin rate (rpm) | 6850 | 7000 | 6800 | 6850 | 6800 |
| Durability | | 105 | 110 | 100 | 125 | 100 |

TABLE 11

| Result of Evaluation | | Compa. Ex. 4 | Compa. Ex. 5 | Compa. Ex. 6 | Compa. Ex. 7 | Compa. Ex. 8 |
|---|---|---|---|---|---|---|
| H(5.0) − Ho | | 5.0 | 11.0 | 7.0 | 11.0 | 11.0 |
| H(12.5) − H(5.0) | | 10.0 | −1.0 | 3.0 | 1.0 | 1.0 |
| Hs − H(12.5) | | 16.0 | 17.0 | 3.0 | 15.0 | 15.0 |
| Hs − Ho | | 31.0 | 27.0 | 13.0 | 27.0 | 27.0 |
| H2 − H3 | | 36 | 36 | 36 | — | −7 |
| Deformation CD (mm) | | 2.9 | 2.9 | 2.9 | 2.7 | 2.8 |
| W#1 | Ball speed (m/s) | 65.1 | 64.9 | 65.0 | 66.0 | 65.7 |
| | Spin rate (rpm) | 3030 | 3070 | 3380 | 2800 | 2930 |
| | Flight distance (m) | 237 | 228 | 225 | 246 | 243 |
| SW | Spin rate (rpm) | 6700 | 6750 | 6800 | 5400 | 5700 |
| Durability | | 60 | 95 | 105 | 80 | 90 |

As shown in Tables 8 to 11, the golf balls according to Examples are excellent in various performance characteristics. From the results of evaluation, advantages of the present invention are clear.

The golf ball according to the present invention can be used for playing golf on golf courses and practicing at driving ranges. The above descriptions are merely for illustrative examples, and various modifications can be made without departing from the principles of the present invention.

What is claimed is:

1. A golf ball comprising a core, a mid layer positioned outside the core, and a cover positioned outside the mid layer, wherein a difference between: a JIS-C hardness H(5.0) at a point that is located at a distance of 5 mm from a central point of the core; and a JIS-C hardness Ho at the central point is equal to or greater than 6.0, a difference between: a JIS-C hardness H(12.5) at a point that is located at a distance of 12.5 mm from the central point; and the hardness H(5.0) is equal to or less than 4.0, a difference between a JIS-C hardness Hs at a surface of the core and the hardness H(12.5) is equal to or greater than 10.0, a difference between the hardness Hs and the hardness Ho is equal to or greater than 22.0, there is no zone in which a hardness decreases from the central point toward the surface, and a Shore D hardness H2 of the mid layer is greater than a Shore D hardness H3 of the cover.

2. The golf ball according to claim 1, wherein the core is formed by crosslinking a rubber composition that includes a base rubber and an organic sulfur compound, and the organic sulfur compound has a molecular weight of 150 or higher but 200 or lower and a melting point of 65° C. or higher but 90° C. or lower.

3. The golf ball according to claim 2, wherein the rubber composition includes the base rubber in an amount of 100 parts by weight, and the organic sulfur compound in an amount that is equal to or greater than 0.05 parts by weight but equal to or less than 3.0 parts by weight.

4. The golf ball according to claim 2, wherein the sulfur compound is 2-naphthalenethiol.

5. The golf ball according to claim 1, wherein the hardness Ho is equal to or greater than 40.0 but equal to or less than 70.0, and the hardness Hs is equal to or greater than 78.0 but equal to or less than 95.0.

6. The golf ball according to claim 1, wherein the hardness H(5.0) is equal to or greater than 63.0 but equal to or less than 73.0.

7. The golf ball according to claim 1, wherein the hardness H(12.5) is equal to or greater than 64.0 but equal to or less than 74.0.

8. The golf ball according to claim 1, wherein the hardness H2 is equal to or greater than 47 but equal to or less than 58.

9. The golf ball according to claim 1, wherein a thickness of the mid layer is equal to or greater than 0.5 mm but equal to or less than 1.5 mm, and a thickness of the cover is equal to or less than 0.8 mm.

10. The golf ball according to claim 1, wherein the hardness H3 is equal to or greater than 20 but equal to or less than 47.

11. The golf ball according to claim 1, wherein a difference (H2−H3) between the hardness H2 and the hardness H3 is equal to or greater than 30.

12. The golf ball according to claim 1, wherein a base polymer of the mid layer is different from a base polymer of the cover, and the golf ball further comprises a reinforcing layer between the mid layer and the cover.

* * * * *